US005143514A

United States Patent [19]

Adachi

[11] Patent Number: 5,143,514

[45] Date of Patent: Sep. 1, 1992

[54] DIFFUSER OF CENTRIFUGAL COMPRESSOR

[75] Inventor: Yasunori Adachi, Itami, Japan

[73] Assignee: Daikin Industries, Ltd., Osaka, Japan

[21] Appl. No.: 537,920

[22] Filed: Jun. 13, 1990

[30] Foreign Application Priority Data

Jun. 13, 1989 [JP] Japan ..... 1-151365

[51] Int. Cl.[5] ..... F01B 25/02; F01D 9/00

[52] U.S. Cl. ..... 415/150; 415/151; 415/207; 415/224.5

[58] Field of Search ..... 415/203, 204, 206, 207, 415/224.5, 148, 150, 151, 159, 163, 126

[56] References Cited

U.S. PATENT DOCUMENTS

| | | | |
|---|---|---|---|
| 2,803,396 | 8/1957 | Darrow | 415/224.5 |
| 3,010,642 | 11/1961 | Dickmann et al. | 415/224.5 |
| 3,173,241 | 3/1965 | Birmann | 415/224.5 |
| 3,289,919 | 12/1966 | Wood . | |
| 3,289,921 | 12/1966 | Soo | 415/207 |
| 4,544,325 | 10/1985 | Rogo et al. | 415/150 |
| 4,932,835 | 6/1990 | Sorokes | 415/150 |

FOREIGN PATENT DOCUMENTS

| | | | |
|---|---|---|---|
| 125547 | 2/1927 | Fed. Rep. of Germany . | |
| 3148756 | 7/1983 | Fed. Rep. of Germany . | |
| 156299 | 2/1980 | Japan . | |
| 0200003 | 11/1983 | Japan | 415/204 |
| 1153345 | 5/1969 | United Kingdom . | |

*Primary Examiner*—Edward K. Look
*Assistant Examiner*—Hoang Nguyen
*Attorney, Agent, or Firm*—Antonelli, Terry Stout & Kraus

[57] ABSTRACT

A diffuser of a centrifugal compressor for guiding a fluid flowing from an impeller to a scroll. The diffuser is formed by a pair of oppositely disposed lateral walls. The diffuser is provided at a fluid outlet portion thereof with an outlet throttling portion. This outlet throttling portion is formed by gradually narrowing the passage width downstream from a starting point which is located in a position at which the fluid dynamic pressure is almost perfectly changed to a static pressure. The provision of the outlet throttling portion decreases the risk of a pressure loss, restrains the possibility of flow separation and prevents the fluid from reversely flowing from the scroll. This results in improvements in surge line and partial load efficiency.

7 Claims, 7 Drawing Sheets

DIFFUSER OF CENTRIFUGAL COMPRESSOR

BACKGROUND OF THE INVENTION

The present invention relates to improvements in a diffuser of a centrifugal compressor used in a centrifugal refrigerator, an air compressor, apparatus for sending natural gas under pressure, or the like.

A centrifugal compressor generally includes a diffuser for reducing the speed of a fluid disposed downstream of the outlet side of an impeller to convert the dynamic energy into a static pressure, and a scroll disposed as connected to the diffuser. The diffuser is generally formed by a pair of parallel lateral walls.

To improve the efficiency of the diffuser in a centrifugal compressor, Japanese Unexamined Patent Publication 156299/1980 proposes a diffuser in which the width of the inlet portion is narrowed in order to prevent the fluid from reversely flowing at the diffuser inlet portion, thereby to reduce the loss due to the fluid eddy.

Even though the width of the inlet portion is narrowed, the flow separation may be restrained only to a limited extent and a portion of the flow may be arranged. In particular, when the width of the inlet portion is narrowed too much, the conformity of the impeller with the diffuser is lost to increase the loss. This may not only impose restrictions on improvements in partial load efficiency, but also induce decrease in both rated efficiency and maximum flow rate. Further, even though the width of the inlet portion is narrowed, the surge line cannot be heightened.

SUMMARY OF THE INVENTION

In view of the foregoing, the present invention proposes providing a diffuser of a centrifugal compressor capable of providing a good flow of a fluid, improving the rated efficiency and the partial load efficiency over a wide range, and heightening the surge line.

The object above-mentioned may be achieved by the providing a centrifugal compressor diffuser formed by a pair of lateral walls oppositely disposed downstream of a fluid outlet of an impeller and being adapted to guide a fluid flowing from the impeller to a scroll. The diffuser includes comprising; at a fluid outlet portion thereof, an outlet throttling portion of which passage width is gradually narrowed downstream from a starting point located in the position where the dynamic pressure of the fluid is almost perfectly changed to a static pressure.

Preferably, the minimum passage width of the outlet throttling portion is set to $\frac{3}{8}$ or more and $\frac{3}{4}$ or less of the passage width upstream of the outlet throttling portion.

Preferably, the starting point from which the outlet throttling portion is throttled, is positioned between 70% and 90% of the passage of the diffuser.

Preferably, the diffuser is provided at the inlet portion thereof with an inlet throttling portion of which passage width is gradually narrowed downstream, and the minimum passage width of the inlet throttling portion is set to 75% or more and 95% or less of an outlet width of the impeller according to a rated flow amount.

Preferably, the scroll is disposed as biased toward one of the pair of lateral walls, and the outlet throttling portion is formed by inclining the one lateral wall toward the passage.

Preferably, the diffuser includes a movable lateral wall for adjusting the passage width which is disposed on at least that portion of either one of the lateral walls which forms the outlet throttling portion, and the diffuser also includes movable lateral wall operating means for moving the movable lateral wall according to a load. In this case, the movable lateral wall operating means is preferably adapted to so move the movable lateral wall as to narrow the passage width when the vane opening degree becomes small.

Preferably, the movable lateral wall operating means includes a drive shaft for rotatingly driving a vane disposed for controlling the flow rate of a fluid sucked by the impeller, an eccentric cam rotatable integrally with the drive shaft, and a rod for moving the movable lateral wall in such a direction as to narrow the passage width when the rod is pressed by the eccentric cam.

According to the diffuser of a centrifugal compressor having the above-described arrangement, the outlet throttling portion is formed at the outlet portion where the change to a static pressure is about to be completed. This minimizes the pressure loss. This restrains the flow separation and prevents the fluid from reversely flowing from the scroll.

To heighten the surge line and improve the partial load efficiency, it is found advantageous to set the minimum passage width of the outlet throttling portion to $\frac{3}{8}$ or more and $\frac{3}{4}$ or less of the passage width upstream of the outlet throttling portion.

To heighten the surge line and improve the partial load efficiency, it is further advantageous that the starting point from which the outlet throttling portion is throttled, is positioned between 70% and 90% of the passage of the diffuser.

Further, when the diffuser is provided at the inlet portion thereof with an inlet throttling portion of which minimum passage width is 75% or more and 95% or less of the outlet width of the impeller according to a rated flow rate, it is possible to reduce the distortion and inclination of the flow at the diffuser inlet portion. Accordingly, such an arrangement is preferred not only to improve the general efficiency including the rated efficiency and the partial load efficincy, but also to increase the surge margin. Further, there is no likelihood that the maximum flow rate is decreased.

When the scroll is disposed as biased toward one lateral wall of the diffuser and the outlet throttling portion is formed by inclining the one lateral wall toward the passage, such an arrangement effectively prevents the fluid from reversely flowing from the scrol. Thus, the efficiency may be further improved.

When the diffuser includes a movable lateral wall for adjusting the passage width which is disposed on at least that portion of either one of the lateral walls which forms the outlet throttling portion, and the diffuser also includes movable lateral wall operating means for moving the movable lateral wall according to a load, the movable lateral wall operating means is adapted to move the movable lateral wall according to the load, thereby to adjust the passage width to the optimum value. Thus, the efficiency may be improved regardless of the magnitude of the load, leading to economy of energy. In this case, when the movable lateral wall operating means is adapted to so move the movable lateral wall as to narrow the passage width when the vane opening degree becomes small, the passage width may be quickly adjusted in response to variations of the load.

When the movable lateral wall operating means includes the drive shaft for rotatingly driving the vane, the eccentric cam rotatable integrally with the drive shaft, and the rod for moving the movable lateral wall, the following result may be produced. That is, when the vane is rotatingly driven by the drive shaft to reduce the vane opening degree to decrease the flow rate of a fluid suctioned by the impeller, the eccentric cam rotated with the rotation of the drive shaft causes the rod to push and move the movable lateral wall, thereby to narrow the passage width. When the vane is rotatingly driven by the drive shaft to increase the flow rate of the fluid suctioned by the impeller, the eccentric cam rotated with the rotation of the drive shaft permits the rod to retreat. Accordingly, the pressure in the diffuser causes the movable lateral wall to be moved in such direction as to broaden the passage width. To improve the diffuser efficiency, the adjustment of the passage width according to a load is made in a mechanical manner. This provides a reliable operation and makes the structure simple to reduce the production cost. Further, the throttling degree of the passage width according to the vane opening degree may be readily adjusted by changing the shape of the eccentric cam.

DESCRIPTION OF THE PREFERRED EMBODIMENTS

The following description will discuss in detail the present invention with reference to the attached drawings showing embodiments thereof.

Figure 1:
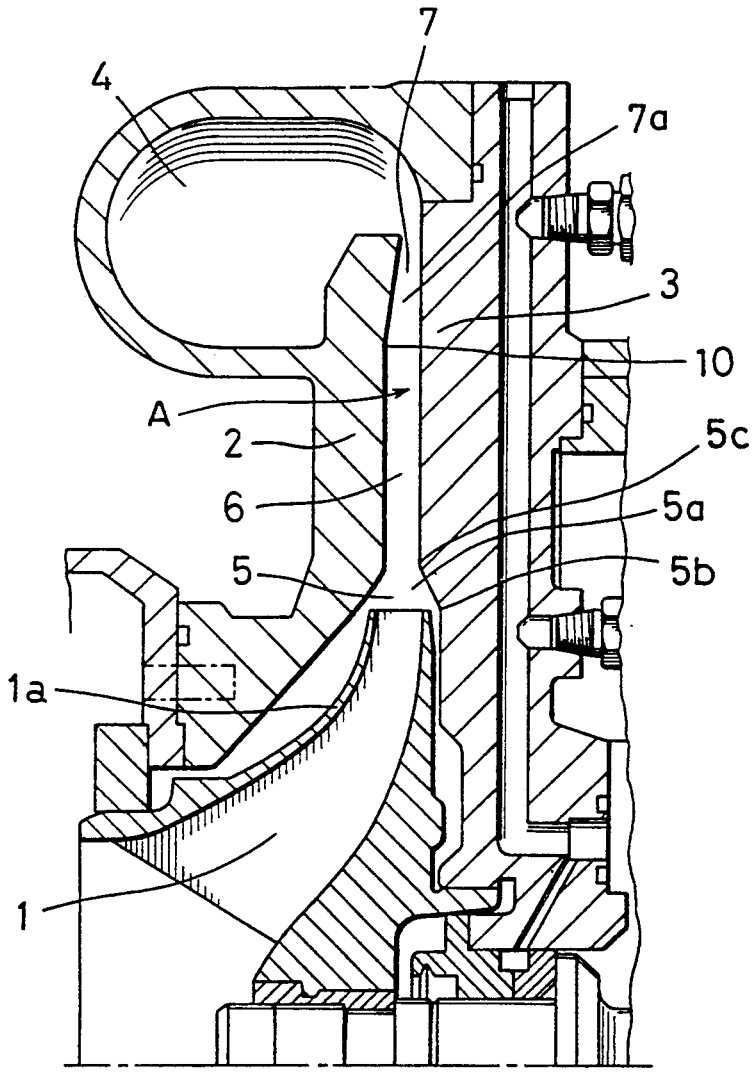
FIG. 1 is a section view of main portions of a centrifugal compressor including an embodiment of diffuser in accordance with the present invention.

In FIG. 1, a diffuser generally designated by the reference character A is formed by a pair of lateral walls 2 and 3 extending in the discharge direction of an impeller 1. A scroll 4 is connected to the diffuser A and is formed as biased toward one lateral wall 2.

The diffuser A is composed of an inlet portion 5, an intermediate portion 6 and an outlet portion 7 which have different shapes and which are successively disposed in the direction from upstream to downstream.

Figure 2:
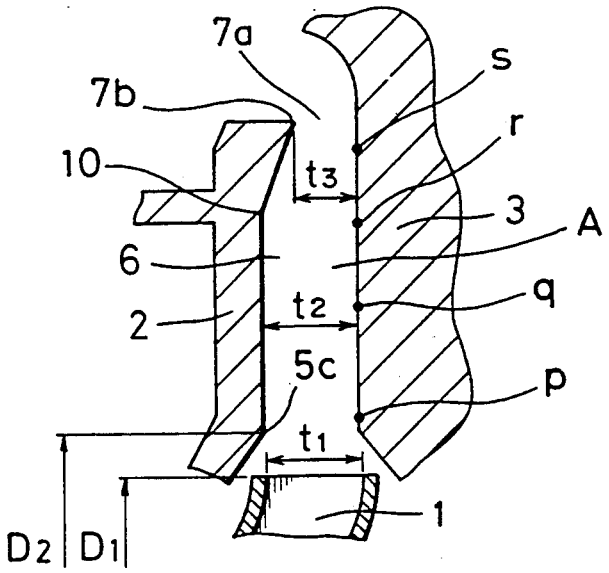
FIG. 2 is a section view of the diffuser in accordance with the present invention.

In FIG. 2, an inlet throttling portion 5*a* is formed at the inlet portion 5 by inwardly inclining both lateral walls 2 and 3 to narrow downstream the width of the passage formed therebetween. In the intermediate portion 6, the lateral walls 2 and 3 are parallel with each other, and the passage width $t_2$ thereat is constant. The minimum passage width of the inlet throttling portion 5*a* (which is equal to the passage width $t_2$ of the intermediate portion 6), is set to 75% or more and 95% or less of the outlet width $t_1$ of the impeller 1. The throttling ratio of the inlet throttling portion 5*a* is the same range of 70% to 95%.

The diameter $D_2$ of a tapering end 5*c* of the inlet throttling portion 5*a* is preferably set to about 1.05 to about 1.2 times the outlet diameter $D_1$ of the impeller 1. The inclination angles of the lateral walls 2, 3 at the inlet throttling portion 5*a* are preferably about 15° to about 30°.

The diffuser A is provided at the outlet portion 7 thereof with an outlet throttling portion 7*a* which is formed by gradually narrowing the passage width downstream from a starting point 10. The passage width of the outlet throttling portion 7*a* is narrowed by inclining, toward the passage, the lateral wall 2 toward which the scroll 4 is biased.

Figure 3:
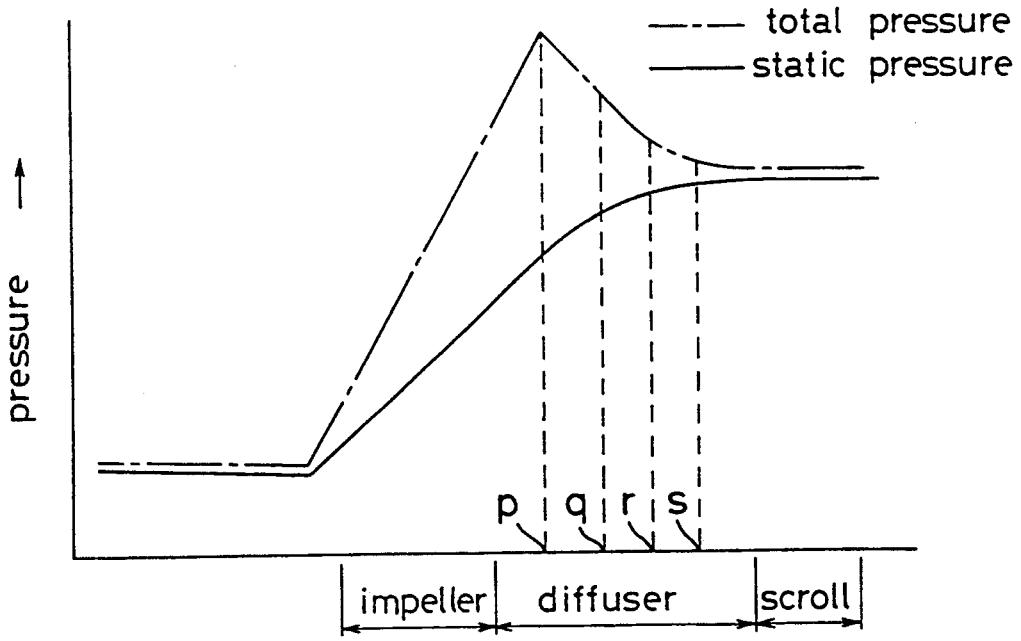
FIG. 3 is a view illustrating a pressure distribution at different component elements of a centrifugal compressor.

The starting point 10 is located in that position in the vicinity of the outlet portion 7 of the diffuser A where the dynamic pressure of a fluid is almost perfectly changed to a static pressure, i.e., in the vicinity of a point r in FIG. 3 showing how the static pressure is changed from upstream to downstream. When the diameter of the impeller 1, the entire length of the diffuser and the like are taken into consideration, the starting point 10 is preferably located in a position spaced from an inlet 5*b* (FIG. 1) by a distance corresponding to about 70 to 90% of the passage length of the diffuser. It is required that the position of the starting point 10 is moved toward the scroll 4 (i.e., upward in FIG. 1) when the rated head is high.

The tapering angle at the outlet throttling portion 7*a* is 15° or more and 25° or less. The minimum passage width $t_3$ at the outlet throttling portion 7*a* is set to $\frac{3}{8}$ or more and $\frac{3}{4}$ or less of the passage width $t_2$ of the intermediate portion 6. At the outlet throttling portion 7*a*, the lateral wall 2 is disposed as projecting to the vicinity of the diametrial center of the scroll 4. An outlet 7*b* is not edged but is chamfered. This chamfered face may be parallel with the lateral wall 3 or may be round.

According to this embodiment, there is disposed the outlet throttling portion 7*a* of which passage width is narrowed from the starting point 10 which is located in a position in the vicinity of the outlet portion 7 where the static pressure is almost perfectly changed, i.e., in the vicinity of the point r in FIG. 3. Accordingly, this outlet throttling portion 7*a* may not only restrain the flow separation, but also increase the static pressure and prevent the fluid from reversely flowing from the scroll 4. Thus, the surge line may be heightened and the partial load efficiency may be improved.

In particular, the minimum passage width $t_3$ of the outlet throttling portion 7*a* is $\frac{3}{8}$ or more and $\frac{3}{4}$ or less of the passage width $t_2$ of the intermediate portion 6. This is of great advantage to increase in surge margin and improvements in rated efficiency and partial load efficiency. Further, the starting point from which the outlet throttling portion 7*a* is throttled, is located in a position spaced from the diffuser inlet by a distance corresponding to 70 to 90% of the passge length of the diffuser. Such arrangement is of greater advantage to increase in surge line and improvements in partial load efficiency.

The diffuser is provided at the inlet portion 5 thereof with the inlet throttling portion 5*a* of which passage width is narrowed downstream. The passage width $t_2$ of the intermediate portion 6 is 75% or more and 95% or less of the impeller outlet width $t_1$ according to the rated flow rate. This decreases the risk of distortion, inclination or the like of the flow at the inlet portion 5 of the diffuser. The multiple effect of the inlet throttling portion 5*a* and the outlet throttling portion 7*a* may not only improve the general efficiency including rated efficiency and partial load efficiency, but also increase the surge margin without the maximum flow rate lowered.

Further, the scroll 4 is disposed as biased toward one lateral wall 2, and the outlet throttling portion 7*a* is formed by inclining the one lateral wall 2 toward the passage. This effectively prevents the flow from reversely flowing from the scroll 4, thereby to further improve the partial load efficiency.

Figure 4:
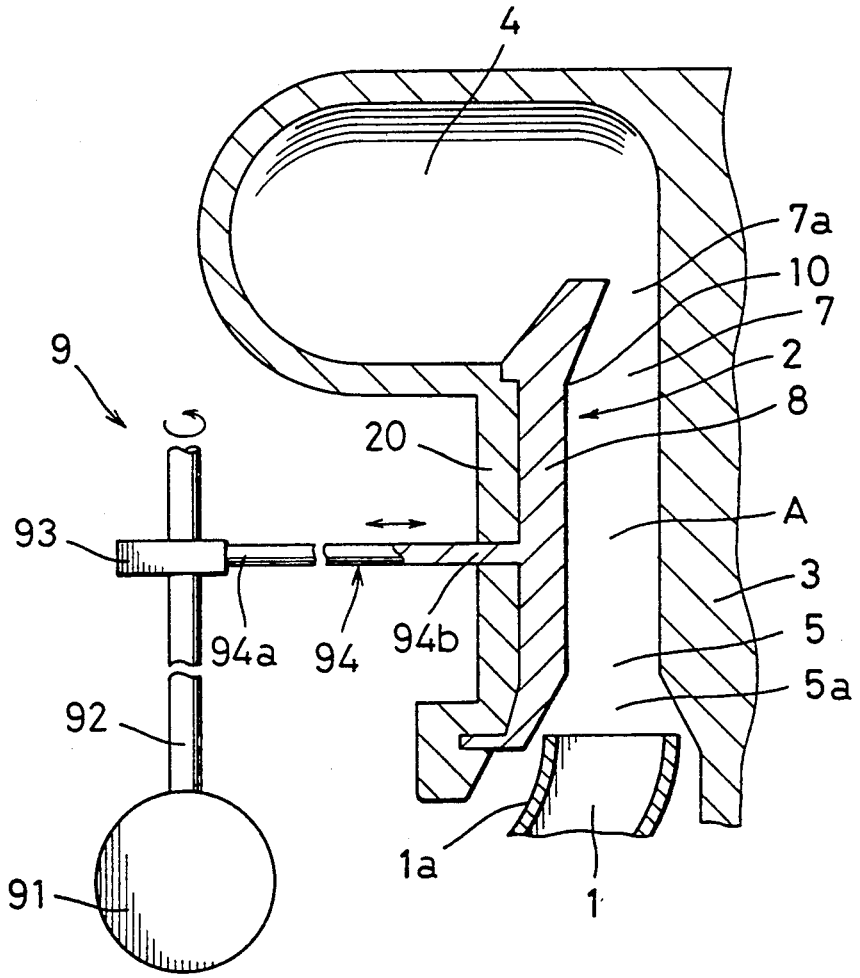
FIG. 4 is a schematic view of portions of a centrifugal compressor including another embodiment of the diffuser in accordance with the present invention.

FIG. 4 shows a diffuser which has the same passage configuration and width as those of the embodiment in FIG. 1, but which has a movable lateral wall.

In FIG. 4, a lateral wall 2 toward which a scroll 4 is biased, has a base lateral wall 20 and a movable lateral wall 8 which is movably attached to the base lateral wall 20. The diffuser in FIG. 4 further has movable lateral wall operating means 9 for moving the movable lateral wall 8.

The movable lateral wall operating means 9 has a vane 91 disposed at the suction port of a compressor and adapted to be rotatingly driven by a drive shaft 92, an eccentric cam 93 rotatable integrally with the drive shaft 92, and a rod 94 having one end 94*a* which comes in contact with the eccentric cam 93, and the other end 94*b* which passes through the base lateral wall 20 and which is secured to the reverse surface of the movable lateral wall 8.

The embodiment in FIG. 4 produces not only the same operational effects as those in the embodiment in FIG. 1, but also the following operational effects.

Figure 5:
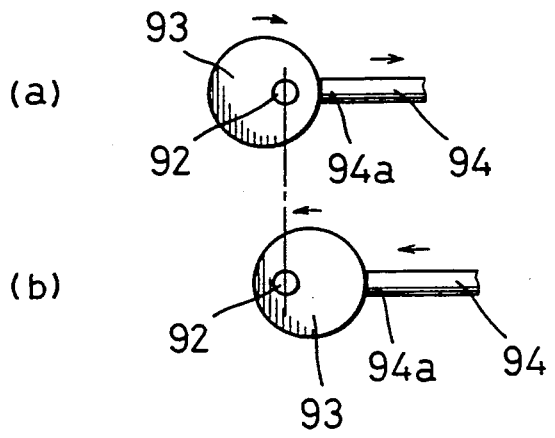
FIG. 5 (*a*) and (*b*) are schematic views illustrating the operation of an eccentric cam.

More specifically, when the drive shaft 92 rotates the vane 91 in such a direction as to close the suction port, the flow rate of a fluid suctioned by the impeller 1 is decreased. On the other hand, with the rotation of the drive shaft 92, the eccentric cam 93 is rotated clockwise from the state shown in FIG. 5 (*a*) to the state shown in FIG. 5 (*b*), causing the rod 94 to be pushed and moved. This causes the movable lateral wall 8 to be moved rightward in FIG. 4, so that the passage width is narrowed.

When the vane 91 is rotated in such a direction as to open the suction port, the flow rate of a fluid suctioned by the impeller 1 is increased. On the other hand, with the rotation of the drive shaft 92, the eccentric cam 93 is rotated counterclockwise from the state shown in FIG. 5 (*b*) to the state shown in FIG. 5 (*a*), thus allowing the rod 94 to be moved toward the eccentric cam 93. Accordingly, the pressure in the diffuser causes the movable lateral wall 8 to be moved in such a direction as to broaden the passage width. Thus, the passage width may be adjusted according to increase/decrease in load. This may not only improve the diffuser efficiency regardless of the magnitude of the load, but also save the energy consumption. In particular, the passage width may be adjusted according to the opening degree of the vane 91. This enables such adjustment to be quickly made in response to variations of the load.

Further, to improve the diffuser efficiency, the adjustment of the passage width according to the load may be made in a mechanical manner. This provides a reliable operation and makes the structure simple to reduce the production cost. Further, the adjustment of the drawing degree of the passage width according to the vane opening degree may be readily made by changing the shape of the eccentric cam.

Figure 6:
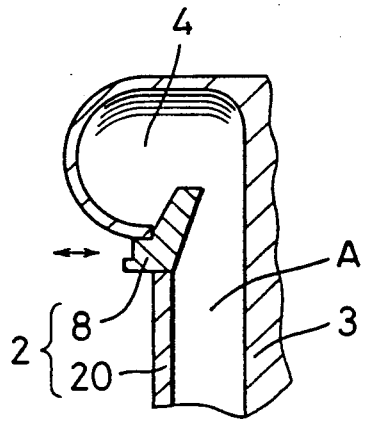
FIG. 6 is a schematic view of main portions of a centrifugal compressor including a further embodiment of the diffuser in accordance with the present invention.

According to this embodiment in FIG. 4, the movable lateral wall may be disposed only at the outlet throttling portion 7*a* of the diffuser, as shown in FIG. 6.

Alternately, the rod 94 may be hydraulically moved, assuring the movement of the movable lateral wall 8.

Further, provision may be made such that the rod 94 is moved by deformation of a spring made of a shape memory alloy as heated by a heater. Such an arrangement eliminates the drive means such as a motor or the like, thus reducing the cost.

COMPARATIVE EXAMPLES I to IV

There were made diffusers of Comparative Examples I to III in which only the inlet portions were respectively throttled at the throttling ratios ($t_1/t_2$) shown in the following Table 1. In a diffuser of Comparative Example IV, the inlet portion was not throttled at all.

TABLE 1

| | Inlet Throttling Ratio $t_1/t_2$ |
|---|---|
| Comparative Example I | 0.95 |
| Comparative Example II | 0.8 |
| Comparative Example III | 0.7 |
| Comparative Example IV | 1.0 |

The partial load efficiency was measured on each of the Comparative Examples I to IV. The results are shown in FIG. 7.

Figure 7:
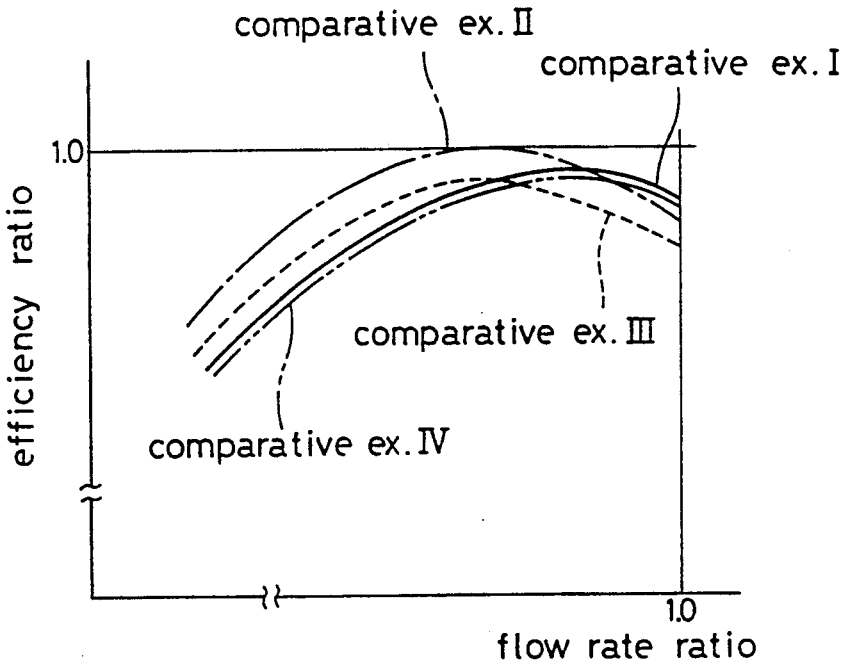
FIG. 7 is a view illustrating the relationship between flow rate ratio and efficiency.

As shown in FIG. 7, Comparative Example II presenting the throttling ratio of 0.8 produces the optimum result for a normal rated flow rate which corresponds to about 80 to 90% of the maximum flow rate, while Comparative Example I presenting the throttling ratio of 0.95 produces the optimum result for a flow rate higher than the normal rated flow rate. In Comparative Example III presenting the throttling ratio of 0.70, the inlet portion was throttled too much so that the conformity of the diffuser with the impeller 1 was lost, thereby to increase the loss. Thus, it is found that Comparative Example III cannot be practically used.

From the foregoing, it is found that the diffuser presenting the throttling ratio of about 0.8 is most preferred among the diffusers having throttled inlet portions. It is presumed that diffusers of which inlet portions are throttled at a ratio from 0.75 to 0.95, are practically preferred.

TEST EXAMPLES I and II, and COMPARATIVE EXAMPLE II

In addition to Comparative Example II producing the most preferred result among the diffusers of which only inlet portions were throttled, there were made a diffuser of Test Example I of which only outlet portion was throttled, and a diffuser of Test Example II of which inlet portion was throttled at the same ratio as that of Comparative Example II and of which outlet portion was throttled at the same ratio as that of Test Example I (See Table 2).

TABLE 2

| Throttling Ratio | $t_1/t_2$ at the inlet | $t_3/t_2$ at the outlet |
|---|---|---|
| Test Example I | 1.0 | 0.5 |
| Comparative Example II | 0.8 | 0.5 |
| Test Example II | 0.8 | 1.0 |

Figure 8:
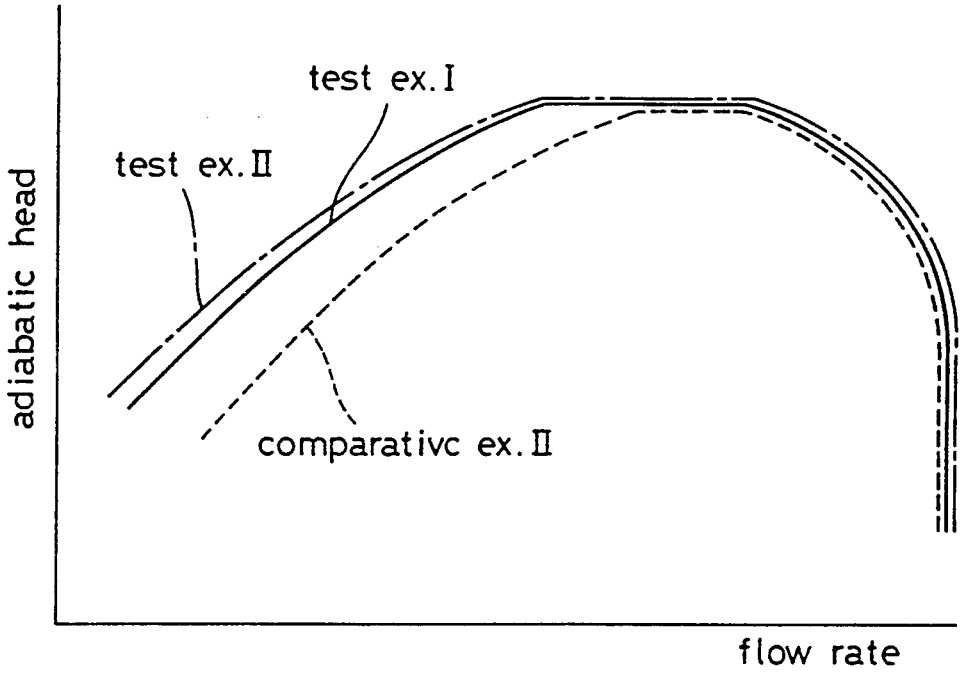
FIG. 8 is a view illustrating a surge line.

With the use of Test Examples I, II and Comparative Example II, the surge lines were measured. The results are shown in FIG. 8. Also, the partial load efficiencies were measured. The results are shown in FIG. 9.

As shown in FIG. 8, the surge lines of Test Example I of which only outlet portion was throttled and Test Example II of which both inlet and outlet portions were throttled, are higher, throughout the range from a low flow rate to a high flow rate, than the surge line of Comparative Example II of which only inlet portion was throttled. This proves that provision of the outlet throttling portion improves the surge line. The surge line of Test Example II is slightly higher than the surge line of Test Example I. It is presumed that such a result is produced by the multiple effect that both inlet and outlet portions are throttled.

Figure 9:
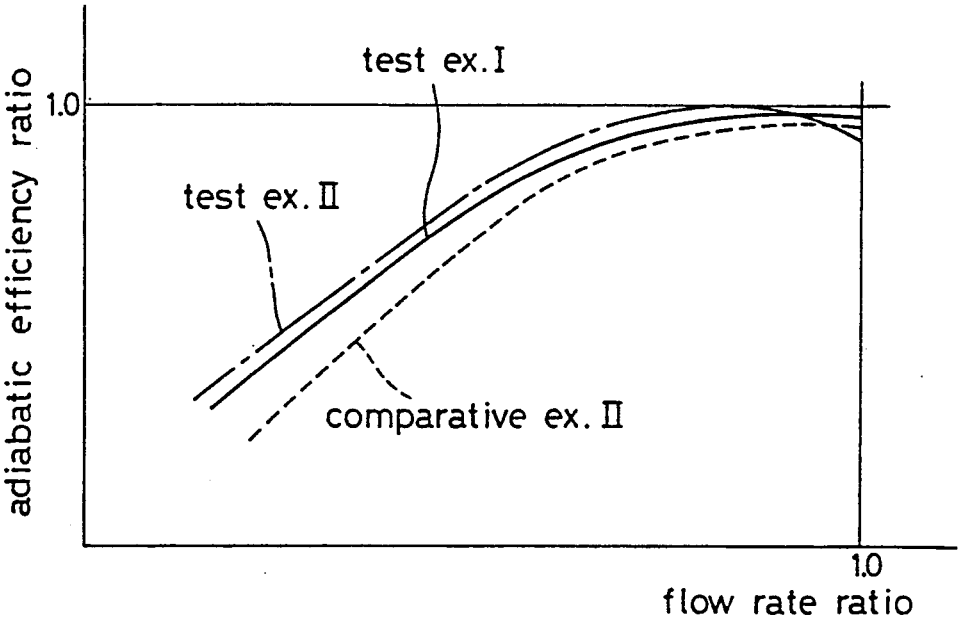
FIG. 9 is a view illustrating partial load efficiency.

As shown in FIG. 9, throughout the range from a low flow rate to a high flow rate, the partial load efficiencies of Test Examples I and II are higher than that of Comparative Example II, and the partial load efficiency of Test Example II is higher than that of Test Example I. This proves that the diffuser of which outlet portion is throttled at a predetermined ratio, may be improved in partial load efficiency more than the most preferred diffuser among the diffusers of which inlet portions are throttled. Further, it is found that the diffuser of which both inlet portion and outlet portion are throttled, is improved in partial load efficiency more than the diffuser of which only outlet portion is throttled. It is presumed that the improvement in efficiency over a wide range is achieved by the multiple effect of the inlet throttling portion 5*a* and the outlet throttling portion 7*a*.

TEST EXAMPLES II, III and COMPARATIVE EXAMPLES II, V

In addition to Test Example II and Comparative Example II, there were made diffusers of Test Examples III and Comparative Example V respectively having the dimensional relationships among the passage width $t_2$, the passage width $t_3$ and the outlet width $t_1$ as shown in Table 3.

TABLE 3

| Throttling Ratio | $t_1/t_2$ at the inlet | $t_3/t_2$ at the outlet |
|---|---|---|
| Test Example II | 0.8 | 0.5 |
| Test Example III | 0.8 | 0.75 |
| Comparative Example II | 0.8 | 1.0 |
| Comparative Example V | 0.8 | 0.25 |

To clarify the influence exerted by the fact that the outlet throttling portion 7*a* was throttled, the inlet throttling portions 5*a* presented the same ratio.

Figure 10:
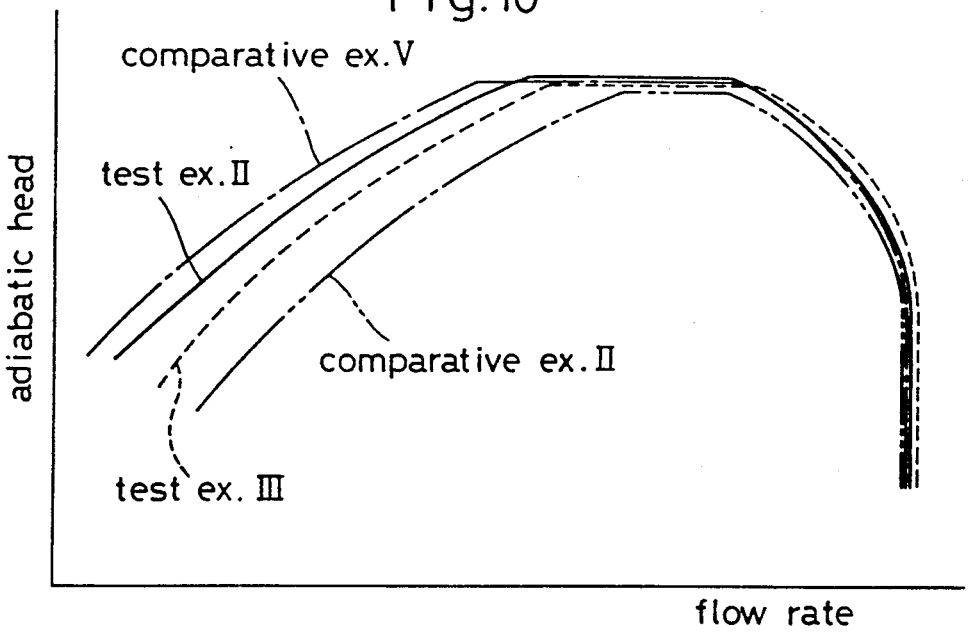
FIG. 10 is a view illustrating a surge line.
Figure 11:
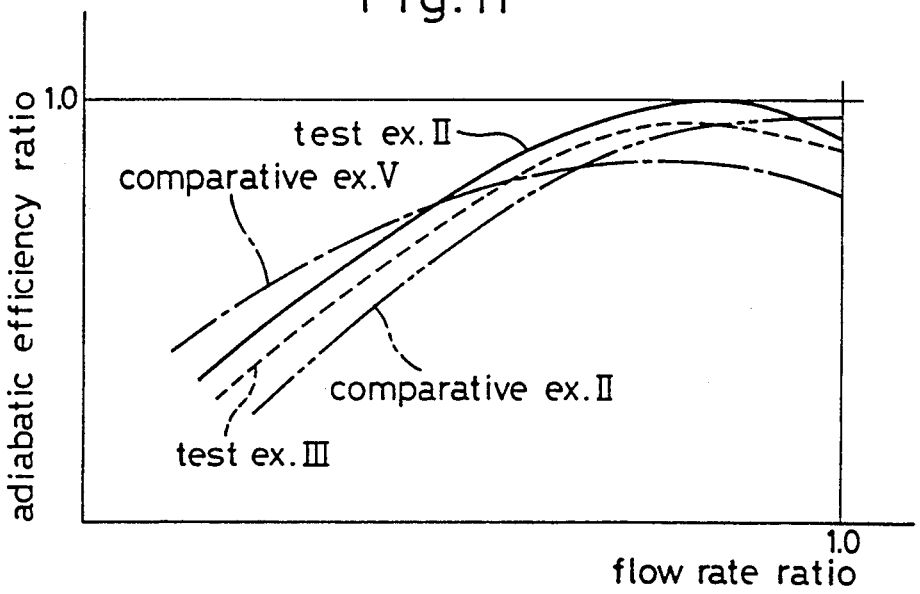
FIG. 11 is a view illustrating partial load efficiency.
Figure 12:
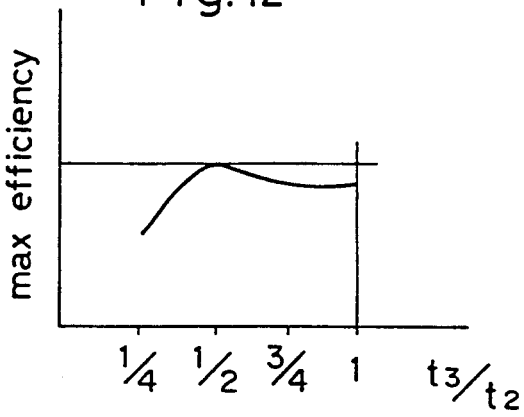
FIG. 12 is a view illustrating the maximum efficiency.

The surge lines of Test Examples and Comparative Examples above-mentioned were measured. The results are shown in FIG. 10. Also, the partial load efficiencies of Test Examples and Comparative Examples above-mentioned were measured. The results are shown in FIG. 11. FIG. 12 shows the maximum efficiencies of respective Examples above-mentioned.

As shown in FIG. 10, throughout the range from a low flow rate to a high flow rate, the surge lines of Test Examples II, III and Comparative Example V of which both inlet portion and outlet portion were throttled, are higher than that of Comparative Example II of which only outlet portion was throttled, and the surge line is higher as the throttling ratio at the outlet is greater in the order of Test Example III, Test Example II and Comparative Example V.

As shown in FIG. 11, the partial load efficiency of Comparative Example V presenting a throttling ratio of 0.25 at the outlet portion, is higher for a low flow rate and lower for a high flow rate than that of Comparative Example II of which only inlet portion was throttled. The partial load efficiency of Test Example II presenting a throttling ratio of 0.5 at the outlet portion is higher, throughout the flow rate range, than that of Comparative Example II of which only inlet portion was throttled. The partial load efficiency of Test Example III presenting a throttling ratio of 0.75 at the outlet portion is higher than that of Comparative Example II for the range from a low flow rate to an intermediate flow rate, and is substantially equal to that of Comparative Example II for a high flow rate. On the other hand, the Examples of which outlet portions were throttled at a ratio from 0.5 to 1.0, present substantially the same maximum efficiency, as shown in FIG. 12.

When the use of a diffuser of which both inlet and outlet portions are throttled, for a normal rated flow rate and the use thereof with a partial load are taken into consideration, it is presumed that both rated efficiency and partial load efficiency may be improved in a good balance by setting the minimum passage width $t_3$ of the outlet throttling portion 7*a* to $\frac{3}{8}$ to $\frac{3}{4}$ of the passage width $t_2$ of the intermediate portion 6.

TEST EXAMPLES I, IV and COMPARATIVE EXAMPLES II, VI

Figure 13:
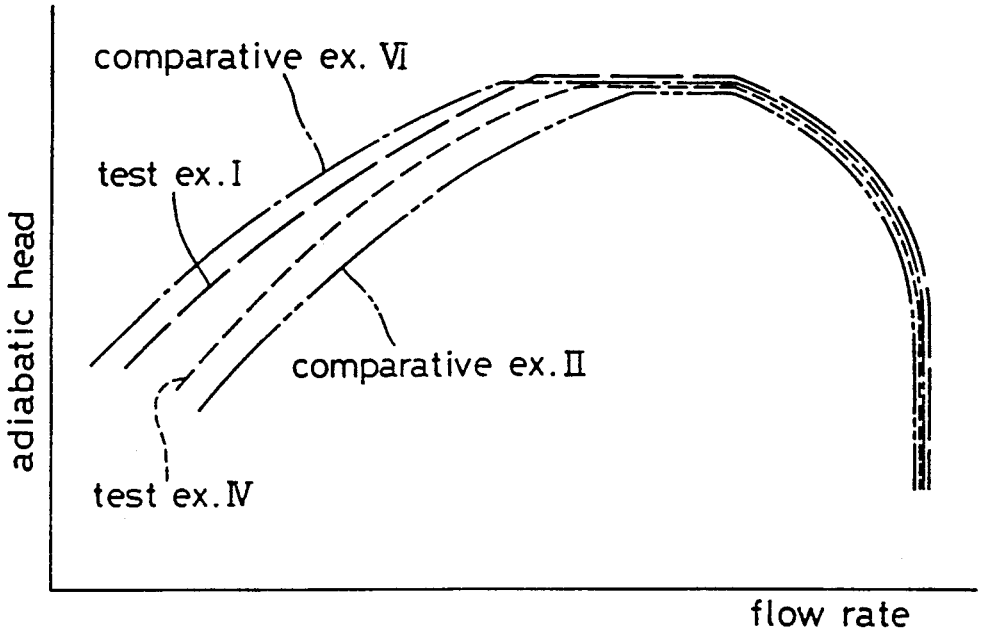
FIG. 13 is a view illustrating a surge line.
Figure 14:
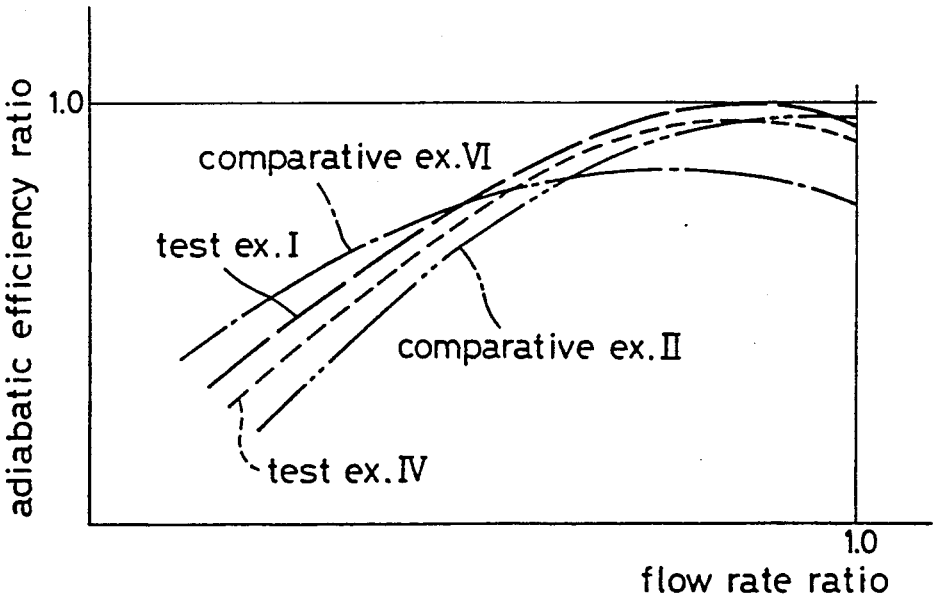
FIG. 14 is a view illustrating partial load efficiency.

In addition to Test Example I and Comparative Example II, there were made diffusers of Test Example IV and Comparative Example VI of which only outlet portions were respectively throttled at ratios shown in Table 4. The surge lines of these Examples were measured. The results are shown in FIG. 13. The partial load efficiencies of these Examples were also measured. The results are shown in FIG. 14.

TABLE 4

| Throttling Ratio | $t_1/t_2$ at the inlet | $T_3/t_2$ at the outlet |
|---|---|---|
| Test Example I | 1.0 | 0.5 |
| Test Example IV | 1.0 | 0.75 |
| Comparative Example II | 0.8 | 1.0 |
| Comparative Example VI | 1.0 | 0.25 |

As shown in FIG. 13, the surge lines of Test Examples I, IV and Comparative Example VI of which only outlet portions were throttled, are higher than that of Comparative Example II which had produced the best result among the diffusers of which only inlet portions were throttled. As the outlet portion is throttled more, the surge line is higher in the order of Test Example IV, Text Example I and Comparative Example VI. As shown in FIG. 14, the partial load efficiency of Comparative Example VI presenting a throttling ratio of 0.25 at the outlet portion, is higher for a low flow rate and much lower for an intermediate flow rate and a high flow rate than that of Comparative Example II of which only inlet portion was throttled. The partial load efficiency of Test Example I presenting a throttling ratio of 0.5 at the outlet portion is higher, throughout the flow rate range, than that of Comparative Example II of which only inlet portion was throttled. The partial load efficiency of Test Example IV presenting a throttling ratio of 0.75 at the outlet portion is higher than that of Comparative Example II for the range from a low flow rate to an intermediate flow rate, and is substantially equal to that of Comparative Example II for a high flow rate.

When the use of a diffuser of which only outlet portion is throttled, for a normal rated flow rate and the use thereof with a partial load are taken into consideration, it is presumed that both rated efficiency and partial load efficiency may be improved in a good balance by setting the minimum passage width $t_3$ of the outlet throttling portion *7a* to $\frac{3}{8}$ to $\frac{3}{4}$ of the passage width $t_2$ of the intermediate portion 6.

It is noted that the efficiencies in FIGS. 7, 9, 11 and 14 are those as measured on lines having a predetermined margin with respect to the surge lines.

In the measurements above-mentioned, Freon 11 was used as a refrigerant. However, even though Flon 12, Freon 22, Flon 123, Flon 134*a* or the like is used as a refrigerant, the equivalent results may be produced in a quantitative analysis Further, the equivalent results may also be produced when, instead of a refrigerant of a refrigerator, air, natural gas or the like is used as the fluid. That is, the present invention may also be applied to a centrifugal compressor for an air compressor or apparatus for sending natural gas under pressure.

What is claimed is:

1. A diffuser of a centrifugal compressor comprising a passage defined by a pair of opposed rigid outer lateral walls disposed downstream of a fluid outlet of an impeller for guiding a fluid flowing from said impeller to a scroll, said passage including an inlet passage portion, an outlet throttling passage portion disposed at a fluid outlet portion of the diffuser, and an intermediate passage portion having a constant passage width equal to a minimum width of the inlet passage portion, wherein a passage width of said outlet throttling passage portion is gradually narrowed downstream from a starting point located at a position in the passage at which dynamic pressure of said fluid is almost perfectly changed to a static pressure, a minimum passage width of the outlet throttling passage portion is $\frac{3}{8}$ or more and $\frac{3}{4}$ or less than the passage width of the intermediate passage portion, and wherein the starting point from which the outlet throttling portion is throttled is positioned between 70% and 90% of a length of the passage of said diffuser, as measured from an inlet throttling portion of the diffuser.

2. A diffuser of a centrifugal compressor according to claim 1 wherein a minimum passage width of said inlet throttling portion is 75% or more and 95% or less of an outlet width of the impeller according to a rated flow rate.

3. A diffuser of a centrifugal compressor according to claim 1, wherein the scroll is biased toward one lateral wall of the pair of opposed lateral walls, and wherein the outlet throttling portion is formed by inclining said one lateral wall toward the passage.

4. A diffuser of a centrifugal compressor according to claim 1, further comprising a movable lateral wall for adjusting only a the width of the outlet throttling passage portion, said movable lateral wall being disposed on at least that portion of either one of the pair of opposed lateral walls forming the outlet throttling portion; and means for moving said movable lateral wall in dependence upon a load.

5. A diffuser of a centrifugal compressor according to claim 4, wherein the scroll is biased toward one lateral wall of the pair of opposed lateral walls, and wherein the movable lateral wall is disposed on at least that portion of said one lateral wall forming said outlet throttling portion.

6. A diffuser of a centrifugal compressor according to claim 4, wherein said means for moving is adapted to move the movable lateral wall in such a direction so as to narrow the width of the outlet throttling passage portion when a vane opening degree of the centrifugal compressor becomes small.

7. A diffuser of a centrifugal compressor comprising a passage defined by a pair of oppositely spaced rigid outer lateral walls disposed downstream of a fluid outlet of an impeller for guiding a fluid flowing from said impeller to a scroll, said passage comprising:

an inlet passage portion, an outlet throttling portion disposed at a fluid outlet portion of the diffuser, an intermediate passage portion having a constant passage width equal to a minimum width of the inlet passage portion, a passage width of said outlet throttling portion being gradually narrowed downstream from a starting point located in a position where the dynamic pressure of said fluid is almost perfectly changed to a static pressure;

a movable lateral wall for adjusting the passage width, said movable lateral wall being disposed on at least that portion of either one of the lateral walls which forms the outlet throttling portion; and movable lateral wall operating means for moving said movable lateral wall according to a load, wherein the movable lateral wall operating means is adapted to move the movable lateral wall in a direction so as to narrow the passage width of the outlet throttling portion when the vane opening degree becomes small, and wherein the movable lateral wall operating means includes a drive shaft for rotatingly driving a vane disposed for controlling the flow rate of a fluid suctioned by said centrifugal compressor, an eccentric cam rotatable integrally with said drive shaft, and a rod for moving the movable lateral wall in such a direction so as to narrow the passage width of the outlet throttling portion when said rod is pressed by said eccentric cam.

* * * * *